US005579551A

United States Patent [19]

Tommaney

[11] Patent Number: 5,579,551

[45] Date of Patent: Dec. 3, 1996

[54] ARCH SHAPED PILLOW APPARATUS WITH EAR ACCOMODATING HOLE

[76] Inventor: Joseph V. Tommaney, 10555 Turtlewood Ct. #412, Houston, Tex. 77072

[21] Appl. No.: 526,362

[22] Filed: Sep. 11, 1995

[51] Int. Cl.[6] ..... A47G 9/00

[52] U.S. Cl. ..... 5/636; 5/643; 5/632; 128/845

[58] Field of Search ..... 5/636, 638, 639, 5/643, 846, 630, 632; D6/601; 128/845

[56] References Cited

U.S. PATENT DOCUMENTS

| | | | |
|---|---|---|---|
| D. 198,449 | 6/1964 | Kerr | D6/601 |
| 324,785 | 8/1885 | Pitney | 5/643 |
| 1,580,210 | 4/1926 | McCullough | 5/636 |
| 2,910,707 | 11/1959 | Lawser | 5/636 |
| 3,141,179 | 7/1964 | McLean | 5/636 |
| 3,366,106 | 1/1968 | Yan et al. | 128/76 |
| 3,883,906 | 5/1975 | Sumpter | 5/636 |
| 4,320,543 | 3/1982 | Dixon | 5/636 |
| 4,832,007 | 5/1989 | Davis, Jr. | 128/70 |
| 4,850,068 | 7/1989 | Walpin et al. | 5/434 |
| 5,343,582 | 9/1994 | Baylor | 5/636 |

*Primary Examiner*—Alexander Grosz
*Attorney, Agent, or Firm*—Harrison & Egbert

[57] ABSTRACT

A pillow apparatus including an arch member having a generally rigid configuration, a cushioning material extending over an exterior of said arch member, and covering enclosing the cushioning material and the arch member. The arch member has a strength suitable for supporting a human head thereon. The arch member includes an interior radius suitable for allowing a human arm to extend therethrough. A hole is formed at a top of the arch member. This hole has a diameter suitable for receiving a human ear thereon. The hole is centered along the length of the arch member and is also centered along the width of the arch member.

20 Claims, 3 Drawing Sheets

ARCH SHAPED PILLOW APPARATUS WITH EAR ACCOMODATING HOLE

TECHNICAL FIELD

The present invention relates generally to pillows. More particularly, the present invention relates to specially designed pillows that improve human circulation during sleep. Furthermore, the present invention relates to pillows which support the human head at a desired position above the bed.

BACKGROUND ART

Pillows are commonly employed for the support of a human head during sleeping activities. Typically, the pillow is made of a cushioning material which allows the head to rest in a comfortable and natural position above the bed. Pillows are often made of feathers, foam, or other suitable cushioning material.

Unfortunately, conventional pillows often do not facilitate sleep when the user is sleeping in an unusual or an awkward position. Under many circumstances, the user of the pillow will sleep with his or her arm resting below the pillow or below the head. During such sleep activities, circulation is often cut off to the arm by the weight of the head resting on the arm. Many times, such persons awake in the morning only to experience a numb arm. This loss of circulation to the arm can be harmful to the health of the person.

In the past, various U.S. patents have issued on special pillow designs. For example, U.S. Pat. No. 1,580,210, issued on Apr. 13, 1926 describes a pillow that includes a specialized ear slot for receiving the ear of the sleeper. A handrest is positioned on the bottom side of the pillow so as to accommodate the human hand during the sleep activities. The ear is received within a slot formed through the surface of the pillow. A strap is provided on the back side of the pillow so as to fasten the hand therein.

U.S. Pat. No. 2,910,707, issued on Nov. 3, 1959, to M. L. Lawser et al. teaches a bag lounge that includes a pair of pillows. One of the pillows is of a inverted U-shaped design which allows the human head to rest thereon. The arch-like member, used as this pillow design, includes an interior area which is not suitable for receiving human arms therein.

U.S. Pat. No. 3,366,106, issued on Jan. 30, 1968, to Yao et al. teaches a pillow which is designed to accommodate a human nose and, optionally, human ears. Special slots are cut into a tubular member. These slots have a size suitable for receiving a human nose therein. The openings of the tubular configuration allow the person to breathe while sleeping.

U.S. Pat. No. 3,883,906, issued on May 20, 1975 to A. Sumpter teaches a sleeping pillow with tunnel-like openings for receiving the arms of the sleeper. As such, it aids in positioning the sleeping's head with respect to the pillow and prevents the cutting off of circulation in the sleeper's arms. Each of these slots are cut into the pillow so as to fix the arms in a position removed from the head. The head rests in the area between the arms.

U.S. Pat. No. 4,320,543, issued on Mar. 23, 1982, to L. H. Dixon teaches a medical pillow providing stabilized support for the head and neck of the user. The pillow includes a convoluted upper surface. Conventionally, this upper surface is of an egg-carton configuration. The surface of the top is convoluted to provide more uniform vertical support and improve lateral support for the head and neck. No provision is made for the accommodation of the sleeper's arms.

U.S. Pat. No. 4,832,007, issued on May 20, 1989, to Davis, Jr. et al. teaches a pillow of resilient material which has a generally rotatable portion for supporting the cervical region of the user. When a user's neck is received across the pillow, the rotation of the cervical role, in conjunction with collapse of angled chambers defined within the resilient pillow, establishes traction in the cervical region of the user.

U.S. Pat. No. 4,850,068, issued on Jul. 25, 1989, to Walpin et al. describes a multi-dimensional pillow. This pillow includes a core having a cross-sectional thickness gradient along one dimension and at least one geometric piece attached to the core parallel to the direction of the thickness gradient. When the user is in the back-lying position, the geometric piece maintains either the normal lordotic curve of the neck or flexion of the neck and the thickness gradient biases the head in the downslope direction so as to cause a controlled rotation of the head resulting in a traction effect on the upslope side of the neck.

It is an object of the present invention to provide a pillow apparatus that allows the user to sleep in a conventional position.

It is another object of the present invention to provide a pillow apparatus which prevents the loss or reduction of circulation to the lower arm or hand.

It is another object of the present invention to provide a pillow apparatus that establishes a minimum height for the head which allows the breathing passages to maintain an approximately horizontal position.

It is a further object of the present invention to provide a pillow apparatus which prevents the crushing or folding-over of the ear during sleep activities.

It is another object of the present invention to provide a pillow apparatus that maintains the spine in an approximately straight line.

It is a further object of the present invention to provide a pillow apparatus which is compact and which eliminates large unused areas of most pillow.

It is a further object of the present invention to provide a pillow apparatus that facilitates the placement of mechanical or other breathing aids to the person using the pillow.

It is still a further object of the present invention to provide a compact, integral unit, which self-induces proper positioning through the arrangement of an ear receptacle.

These and other objects and advantages of the present invention will become apparent from a reading of the attached specification and appended claims.

SUMMARY OF THE INVENTION

The present invention is a pillow apparatus that comprises an arch member having a generally rigid configuration, a cushioning material extending over an exterior surface of the arch member, and a covering enclosing the cushioning material and the arch member.

The arch member has a length and a width. The arch member has a strength suitable for supporting a human head thereon. The arch member has an interior radius suitable for allowing a human arm to extend therethrough.

A hole is formed on a top of the arch member. This hole has a diameter suitable for receiving a human ear therein.

In the preferred embodiment of the present invention, the arch member has a semi-cylindrical configuration. The arch member is formed from a polymeric material having a thickness of approximately 3/16 inch. The arch member has a width of approximately 5¼ inches and a radius of approximately 4 inches.

The hole has a cylindrical configuration extending below a top surface of the arch member. This cylindrical configuration has a length less than a height of the arch member. The hole is centered along the length and is centered along the width of the arch member.

The arch member also includes a first plurality of ribs extending on the arch member on one side of the hole. This first plurality of ribs extends in parallel relationship lengthwise along the arch member. A second plurality of ribs extends on the arch member on an opposite side of the hole. This second plurality of ribs extends in parallel relationship lengthwise along the arch member. The first and second plurality of ribs are formed in the arch member as downward indentations in the arch member.

The cushioning material is made of an egg-carton foam material. The cushioning material is adhesively affixed to the top exterior surface of the arch member.

The covering material completely encloses the cushioning material and the arch member. The covering material is a sleeve which extends around the cushioning material and the arch member. The sleeve has an open end extending outwardly beyond one end of the arch member. The covering material is removably attached around the arch member.

DETAILED DESCRIPTION OF THE INVENTION

Figure 1:
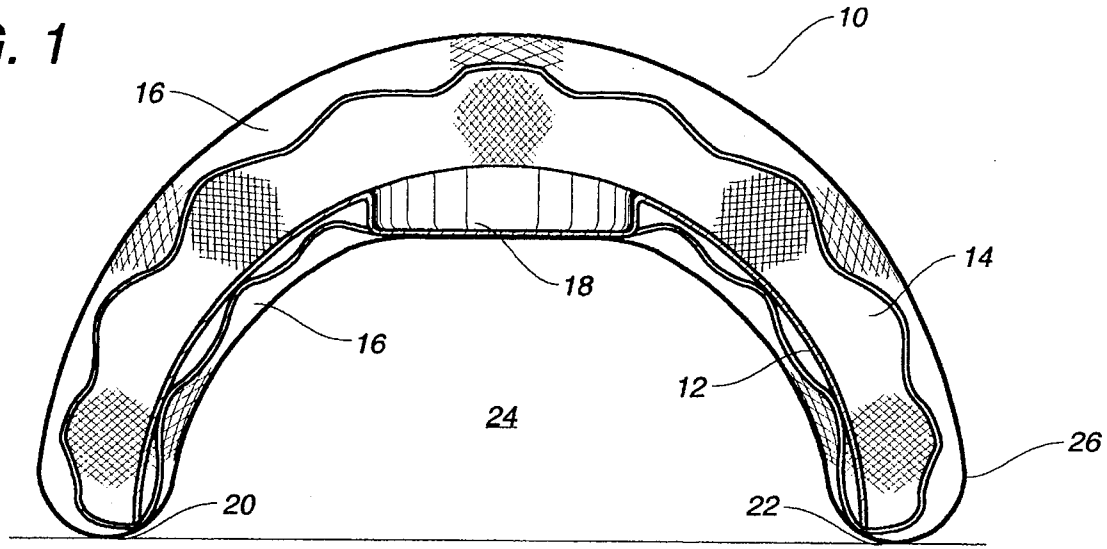
FIG. 1 is a cross-sectional view of the pillow apparatus of the present invention.

In FIG. 1, it can be seen that there is shown at 10 the pillow apparatus in accordance with the preferred embodiment of the present invention. The pillow apparatus 10 includes an arch member 12, a cushioning material 14, and a covering material 16. The cushioning material 14 is affixed to and extends around the top surface and bottom surface of the arch member 12. The covering material 16 is a fabric which extends around and encloses the cushioning material 14 and the arch member 12.

In the present invention, the arch member 12 is of a generally rigid configuration. The arch member 12 is configured so as to have a strength suitable for supporting a human head thereon. The arch member 12 has an interior radius which is suitable for allowing a human arm to extend therethrough. A hole 18 is formed on a top surface of the arch member 12. The hole 18 has a diameter suitable for receiving a human ear therein.

As can be seen in FIG. 1, the arch member 12 has a semi-cylindrical configuration. In the preferred embodiment of the present invention, the arch member is formed of a polymeric material. Experimentation has shown that the proper material thickness of the arch member is approximately 3/16 inch. Spreading of the arch member is prevented by the "biting" effect between the bottom edges 20 and 22 and the surface upon which the pillow 10 is placed. When the thickness is 3/16 inch, the arch member 12 has sufficient strength to prevent any collapse of the arch member. It is desirable with the present invention that the arch member 12 have a certain minimum amount of "give" so as to provide additional comfort to the user of the pillow 10. Additionally, in the preferred embodiment of the present invention, the arch member 12 will have a width of approximately 5¼ inches and a radius of approximately four inches. The four inch radius of the semi-cylindrical configuration of the arch member 12 will provide sufficient room such that the user of the pillow 10 can effectively extend his or her arm through the interior 24 of the pillow apparatus 10. This radius also places the top of the pillow apparatus 10 in a desired position for normal sleeping activities.

As can be seen in FIG. 1, the hole 18 has a cylindrical configuration that extends below a top surface of the arch member 12. This cylindrical configuration of the hole 18 has a length which is much less than the height of the arch member 12. Ideally, the cylindrical configuration of the hole 18 should have a sufficient depth so as to provide comfort to the user without interfering with the user's ability to extend his or her arm through the opening 24 below the arch member 12 of the pillow 10. As will be described hereinafter, the hole 18 is centered along the length of the arch member 12. The hole 18 is also centered along the width of the arch member.

The cushioning material 14 is, preferably, made of an egg-carton foam material. The cushioning material 14 is adhesively affixed to the top and bottom exterior surfaces of the arch member 12. It is possible, within the configuration of the present invention, to allow the cushioning material to extend into the hole 18. The cushioning material 14 can be configured so as to extend into the hole 18 so as to provide a cushioned area between the interior surfaces of the cylindrical configuration of the hole 18 and the ear of the user.

The covering material 16 completely encloses the cushioning material 14 and the arch member 12. In conventional use, the covering material 16 acts as a "pillow case" for the pillow apparatus 10 of the present invention. This covering material 16 can be a decorative fabric material which can be removably attached around the cushioning material 14 and the arch member 12. In the preferred embodiment of the present invention, the covering material 16 is a sleeve which extends around the cushioning material 14 and the arch member 12. This sleeve will have an open end 26 extending outwardly beyond one end of the arch member 12 so as to allow the covering material 16 to be removed for washing and/or cleaning.

Figure 2:
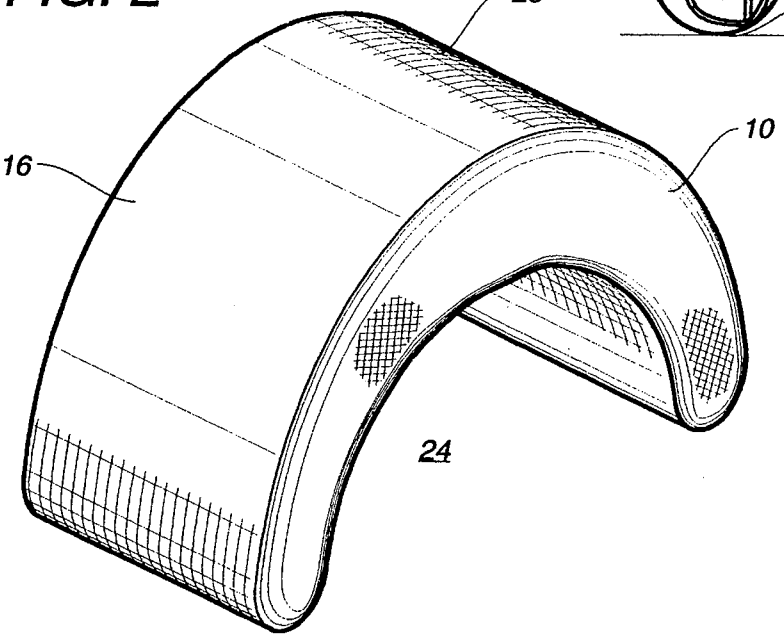
FIG. 2 is a perspective view of the pillow apparatus of the present invention.

FIG. 2 shows the pillow apparatus 10 in its conventional configuration ready for use. As can be seen, the covering material 16 extends completely around the arch member 12 and the cushioning material 14. As such, the pillow apparatus 10 will take on the appearance of a conventional pillow (but for the shape). The configuration of the arch member 12 and the cushioning material 14 will allow an interior area 24 to be available for receiving a human arm therethrough. The top surface 28 of the pillow apparatus 10 is suitable for receiving a human head thereon. The hole 18 will provide a suitable indentation whereby the user's ear can be fitted for sleeping activities. As will be described hereinafter, the arrangement of the hole 18 acts as a "guide" so as to assure that the head is positioned properly on the pillow apparatus 10.

Within the concept of the present invention, it is possible to add a wireless speaker to the bottom of the ear hole 18. The cylindrical configuration of the hole 18 has an ideal acoustic configuration for audio and educational information transmission during sleep. Additionally, the use of such a speaker can facilitate sleeping by providing soothing music or sound. The arch member 12 and the hole 18 have gently rounded corners so as to eliminate any sharp points or possible areas of discomfort for the user.

Figure 3:
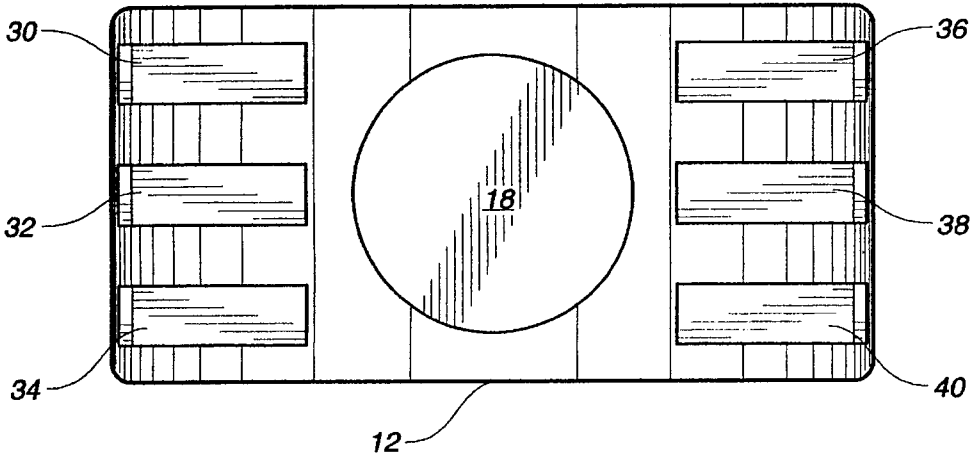
FIG. 3 is an isolated top view of the arch member of the pillow apparatus of the present invention.

FIG. 3 shows an isolated view of the arch member 12 of the present invention. It can be seen that the hole 18 in the arch member 12 is centered along the length and width of the arch member 12. By centering the hole 18, the hole 18 will serve as a proper guide for the positioning of the head upon the pillow. As long as the user's ear is positioned in the hole 18, the head will be resting properly. As such, this hole 18 prevents misuse of the pillow apparatus 10. The hole 18 serves as an alignment tool for the use of the pillow 10.

As can be seen in FIG. 3, a plurality of ribs 30, 32, and 34 extend on the arch member on one side of the hole 18. The ribs 30, 32, and 34 extend in parallel relationship lengthwise along the arch member. Additionally, a second plurality of ribs 36, 38, and 40 extend on the arch member 12 on an opposite side of the hole 18. This second plurality of ribs extends in parallel relationship lengthwise along the arch member. The ribs serve to provide structural integrity and support to the configuration of the arch member 12.

Figure 4:
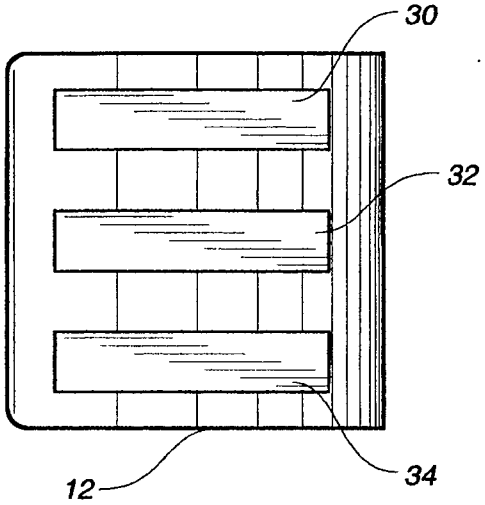
FIG. 4 is an exterior side view of the arch member of the pillow apparatus of the present invention.

FIG. 4 shows a side view with the arch members 30, 32 and 34 particularly illustrated.

Figure 5:
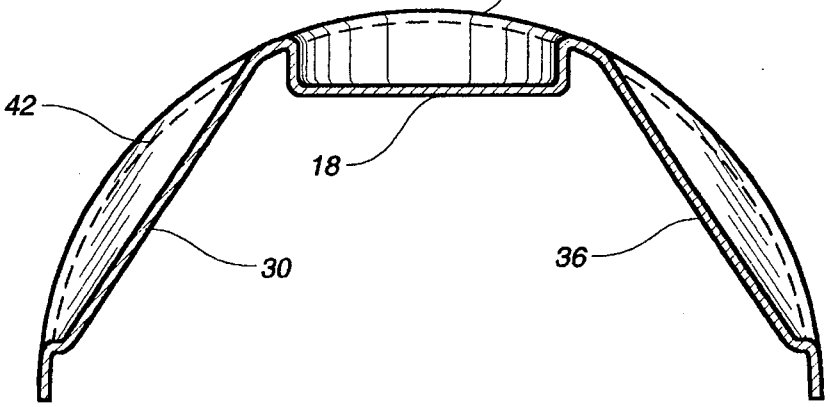
FIG. 5 is an end view of the pillow apparatus of the present invention.

In FIG. 5, it can be seen how the rib member 30 extends as an indentation downwardly from the exterior surface 42 of the arch member 12. Similarly, it can be seen that the arch member 36 extends as a downward indentation from the exterior surface 42 of the arch member 12. The hole 18 also extends downwardly, as a cylindrical configuration, from the exterior surface 42 of the arch member 12.

Figure 6:
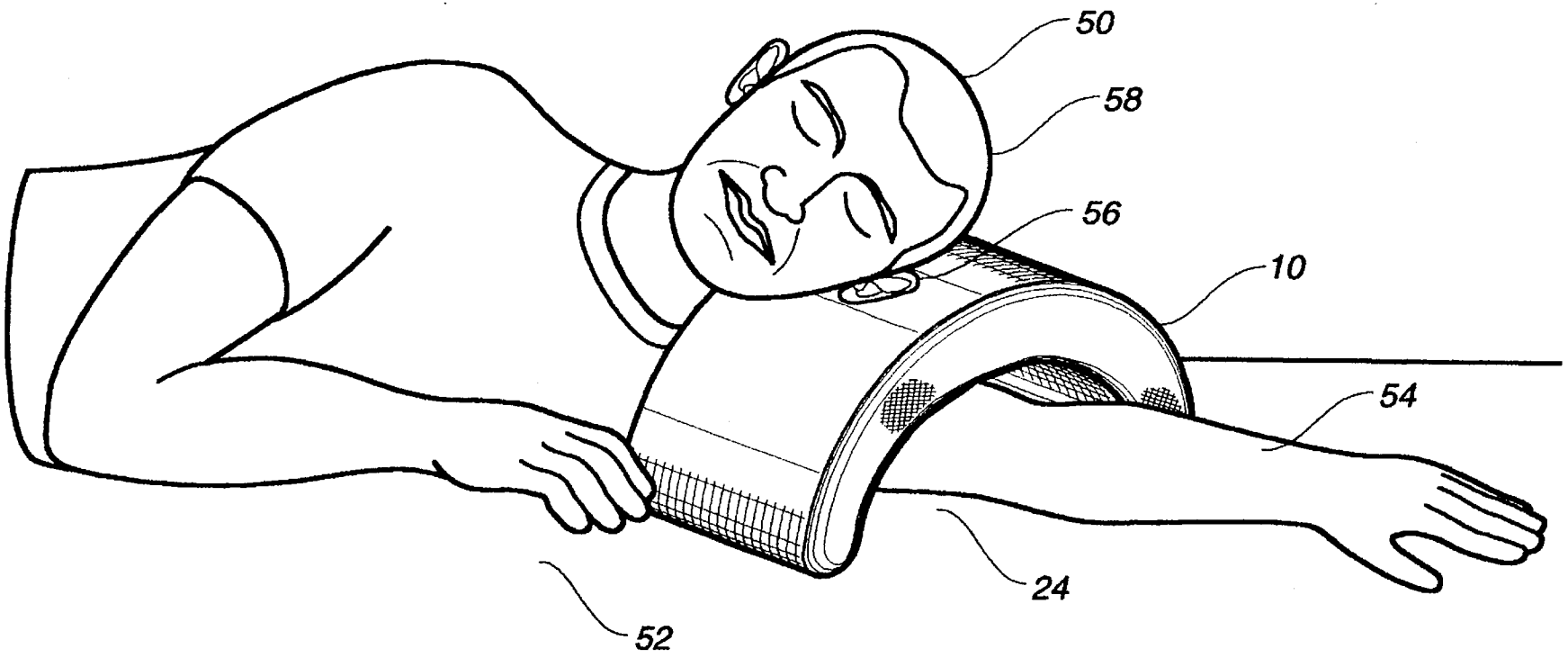
FIG. 6 is a side view showing a preferred use of the pillow apparatus of the present invention.

In FIG. 6, it can be seen that the user 50 is turned so that the user's arm 54 extends through the interior area 24 of the pillow apparatus 10. The user's ear 56 is centered on the hole in the top surface of the arch member 12 of the pillow apparatus 10. The user's arm 54 can extend comfortably through the interior area 24 while the user's head 58 is supported in a desired position above the mattress 52. As such, the user 50 can sleep comfortably without the user's head 58 cutting off circulation to the arm 54.

The present invention has many advantages. Since the device is symmetrical, either end can be placed nearer to the neck. The device functions equally on either arm, without any adaptation necessary.

Once the pillow apparatus is placed on the upper arm and shoulder, the apparatus is then utilized as a pillow, with the head resting on the highest portion of the arch. The cushioned opening provides a natural resting place for the ear or for the back of the head. As such, it automatically positions the head 58 in the preferred position for sleeping on one's side. Should one need to change from sleeping on one side to the other side, one can simply lift the device, turn it over, and place the device over the other arm. The head can then be positioned so that the ear 56 is in the center of the upper opening.

The pillow apparatus 10 of the present invention allows the user to sleep on his or her side. It allows the normal positioning of the head on or over the shoulder and/or upper arm. At the same time, it prevents the loss or reduction of circulation to the lower arm or hand. The pillow apparatus 10 of the present invention prevents any contact whatsoever between the head and the upper arm and/or shoulder.

The present invention establishes a minimum height for the head. As such, it allows the breathing passages to maintain an approximately horizontal position. This facilitates the breathing function for normal users and facilitates the breathing function for those that may have sleeping or respiratory difficulty.

The use of the ear hole 18 prevents the crushing, folding-over or distortion of the ear upon which one sleeps. This distortion is prevented since the ear is in a suspended position in the hole 18 or is resting on the cushioning material which covers the hole 18. The fixed height of the cushioning device tends to maintain the spine in an approximately straight line. As such, the present invention provides possible orthopedic benefits.

The compactness of the pillow apparatus 10 of the present invention eliminates the large unused areas of most pillows. As such, it leaves the space in front of and adjacent to the nose and mouth open. This facilitates the placement of mechanical or other breathing aids. Additionally, it serves to prevent the disarrangement of such aids after they are installed upon the patient. In general, the present invention is a compact, integral unit, which self-induces proper positioning through the use of the cushioned ear receptacle 18.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A pillow apparatus comprising:

an arch member having a generally rigid configuration, said arch member having a length and a width, said arch member having a strength suitable for supporting the human head, said arch member having an interior radius suitable for allowing a human arm to extend therethrough, said arch member having a hole formed at a top of said arch member, said hole having a diameter suitable for receiving a human ear therein;

a cushioning material extending over an exterior surface of said arch member; and a covering enclosing said cushioning material and said arch member.

2. The apparatus of claim 1, said arch member having a semi-cylindrical configuration.

3. The apparatus of claim 2, said arch member being formed from a polymeric material, said polymeric material having a thickness of approximately 3/16 inch.

4. The apparatus of claim 3, said arch member having a width of approximately 5¼ inches and a radius of approximately four inches.

5. The apparatus of claim 1, said hole having a cylindrical configuration extending below the top of said arch member, said cylindrical configuration having a length less than a height of said arch member.

6. The apparatus of claim 1, said hole being centered along the length of said arch member, said hole being centered along the width of said arch member.

7. The apparatus of claim 1, said arch member further comprising:

a first plurality of ribs extending on said arch member on one side of said hole, said first plurality of ribs extending in parallel relationship lengthwise along said arch member; and a second plurality of ribs extending on said arch member on an opposite side of said hole, said second plurality of ribs extending in parallel relationship lengthwise along said arch member.

8. The apparatus of claim 7, said first and second plurality of ribs formed in said arch member as downward indentations on said arch member.

9. The apparatus of claim 1, said cushioning material being of an egg-carton foam material.

10. The apparatus of claim 5, said cushioning material extending around said hole so as to allow an open area extending through said cylindrical configuration, said cushioning material being interposed between said cylindrical configuration and an ear positioned in said hole.

11. The apparatus of claim 10, said cushioning material being adhesively affixed to a top exterior surface of said arch member.

12. The apparatus of claim 1, said covering material completely enclosing said cushioning material and said arch member.

13. The apparatus of claim 12, said covering material being a sleeve extending around said cushioning material and said arch member, said sleeve having an open end extending outwardly beyond one end of said arch member.

14. A pillow apparatus comprising:

an arch member having a generally rigid configuration, said arch member having a length and a width, said arch member having a strength suitable for supporting a human head thereon, said arch member having an interior radius suitable for allowing a human arm to extend therethrough, said arch member having a hole formed at a top of said arch member, said hole having a diameter suitable for receiving a human ear therein, said hole being centered along the length of said arch member, said hole being centered along the width of said arch member; and a cushioning material extending over an exterior of said arch member and around said hole.

15. The apparatus of claim 14, said arch member being formed of a polymeric material, said polymeric material having a material thickness of approximately 3/16 inch.

16. The apparatus of claim 14, said hole having a cylindrical configuration extending below the top of said arch member, said cylindrical configuration having a length less than a height of said arch member.

17. The apparatus of claim 14, further comprising:

a covering material enclosing said cushioning material and said arch member.

18. The apparatus of claim 16, said cushioning material extending around said hole so as to allow an open area extending through said cylindrical configuration, said cushioning material being interposed between said cylindrical configuration and an ear positioned in said hole.

19. The apparatus of claim 14, said arch member having a semi-cylindrical configuration, said arch member having a width of approximately 5¼ inches and a radius of approximately four inches.

20. The apparatus of claim 14, said arch member further comprising:

a first plurality of ribs extending on said arch member on one side of said hole, said first plurality of ribs extending in parallel relationship lengthwise along said arch member; and a second plurality of ribs extending on said arch member on an opposite side of said hole, said second plurality of ribs extending in parallel relationship lengthwise along said arch member.

* * * * *